United States Patent [19]

Holtzapple et al.

[11] Patent Number: 4,825,661

[45] Date of Patent: May 2, 1989

[54] HIGH EFFICIENCY, ORIENTATION-INSENSITIVE EVAPORATOR

[75] Inventors: Mark T. Holtzapple, Brazos, Tex.; Donald M. Ernst, Leola, Pa.

[73] Assignee: The United States of America as represented by the Secretary of the Army, Washington, D.C.

[21] Appl. No.: 174,282

[22] Filed: Mar. 28, 1988

[51] Int. Cl.[4] ..... F25B 41/04

[52] U.S. Cl. ..... 62/225; 62/515; 165/104.26

[58] Field of Search ..... 62/225, 515; 165/104.26

[56] References Cited

U.S. PATENT DOCUMENTS

| | | | |
|---|---|---|---|
| 1,860,027 | 5/1932 | Haymond | 62/515 |
| 4,351,388 | 9/1982 | Calhoun | 165/104.26 |
| 4,470,450 | 9/1984 | Bizzell et al. | 165/104.26 |
| 4,495,988 | 1/1985 | Grossman | 165/104.26 |
| 4,606,198 | 8/1986 | Latshaw et al. | 62/225 |

*Primary Examiner*—Ronald C. Capossela

*Attorney, Agent, or Firm*—Peter A. Taucher; Gail S. Soderling

[57] ABSTRACT

A high efficiency evaporator is disclosed. The evaporator is made with a porous wick on the interior of the evaporator housing to facilitate movement of a refrigerant liquid within the housing. This aids in dispersing the refrigerant.

6 Claims, 3 Drawing Sheets

| EVAP CODE | SPINE ORIENTATION | END VIEW (3X SCALE) |
|---|---|---|
| 1 | WITH FLOW | 1 OPEN |
| 2 | SPIRAL | 1 OPEN |
| 3 | AGAINST FLOW | 1 CLOSED |
| 4 | SPIRAL | 2 OPEN |
| 5 | AGAINST FLOW | 2 OPEN |
| 6 | AGAINST FLOW | 2 CLOSED |
| 7 | WITH FLOW | BARE |
| 8 | BARE | 2 CLOSED |
| 9 | BARE | BARE |

HIGH EFFICIENCY, ORIENTATION-INSENSITIVE EVAPORATOR

GOVERNMENT INTEREST

The invention described herein may be manufactured, used, and licensed by or for the Government for governmental purposes without payment to us of any royalty thereon.

FIELD OF INVENTION

In one aspect this invention relates to evaporation tubes. In a further aspect, this invention relates to heat exchange tubes useful in heating and cooling systems.

Evaporation tubes and heat exchange mechanisms are well known in the art. One example of a heat exchanger is the well known automotive radiator where air passing over a series of fins is used to cool a recirculating liquid which provides cooling for an internal combustion engine. Another example of heat exchangers commonly used are the well-known air conditioning units wherein a high-pressure refrigerant is fed into an enclosed housing as a superheated vapor and the resulting vapor is condensed by means of a condenser heat exchanger exposed to ambient temperature air, the condensate being fed back through an orifice into a low-pressure evaporator heat exchanger chamber where it vaporizes and removes heat from an enclosed space thus maintaining the enclosed space at a temperature below the ambient environment.

In military environments it is proposed to create microclimate cooling units which can be used by individual soldiers or groups of soldiers to cool small climate free from the dangers of the nuclear, biological and chemical compounds occasionally encountered in battle zones. Because such a unit would be carried by or used by a soldier who could be standing or lying in almost any orientation, the heat exchanger or evaporator used in such a unit must be capable of functioning in any orientation. Prior art units used on automobiles and air conditioning systems are designed to be permanently mounted in a fixed orientation and to function in that orientation. Such systems are not designed to be equally effective in any orientation. Other uses for an orientation-insensitive evaporator include cooling applications in space where there is no gravity or in aircraft where the g-forces can operate in a variety of directions.

SUMMARY OF THE INVENTION

A high-efficiency evaporator tube, according to this invention, which is suitable for functioning in any orientation, is formed having a first housing member with an inlet and an outlet. The outer surface of the housing is exposed to a fluid to be cooled and the inner surface of the housing is exposed to a refrigerant liquid suitable for cooling the housing and thereby the fluid in contact with the outer surface of the housing. A porous, liquid-wicking layer is disposed on and attached to the inner surface of the housing. The porous layer of this invention is adapted to wick the refrigerant liquid through the housing so that refrigerant liquid is dispersed and in contact with the fluid housing without regard to the orientation of the housing. Valve means are disposed between the inlet and the source of refrigerant liquid to control the refrigerant liquid flow into the housing.

DETAILED DESCRIPTION OF THE INVENTION

Figure 1:
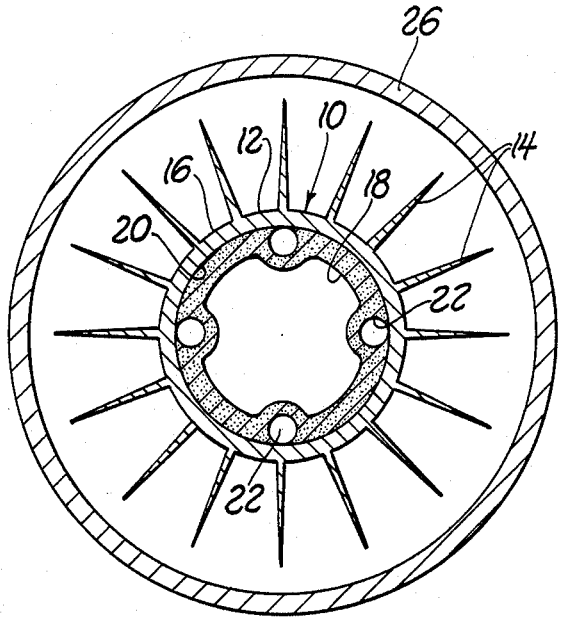
FIG. 1 is end view of one an embodiment made according to this invention.

Referring to the accompanying drawing in which like numerals are used to designate like parts, an end view of a evaporation tube according to this invention is shown in section. The basic evaporator includes a housing 10 which is shown as a circular cross section having a circular wall 12 and a plurality of radially extending fins 14 extending outward from the outer surface 16 of the housing. A porous wicking layer 18 is disposed in the interior of the circular housing 12 and has intimate contact with the inner surface 20 of the circular housing 12. The porous wicking layer will provide nucleation sites for bubble formation and provide a larger interior surface area for heat transfer. Both these characteristics increase the heat which can be transferred. The porous wicking layer 18 is shown formed with a plurality of longitudinal arteries 22 which allow the refrigerant liquid to flow freely longitudinally through the porous wicking layer by capillary action to the inner surface of the circular housing 12 when the liquid reaches a point in the evaporator remote from the inlet. As shown in FIG. 1, the cooling fins 14 can be surrounded by a second retention housing 26 defining an enclosed space between the outer surface 16 of the housing and the inner surface of the retention housing. The use of the retention housing is particularly desirable where it is necessary to recycle the fluid being cooled rapidly and efficiently within a small area or where the fluid being cooled is a liquid and it is necessary to hold the liquid in place.

Figure 2:
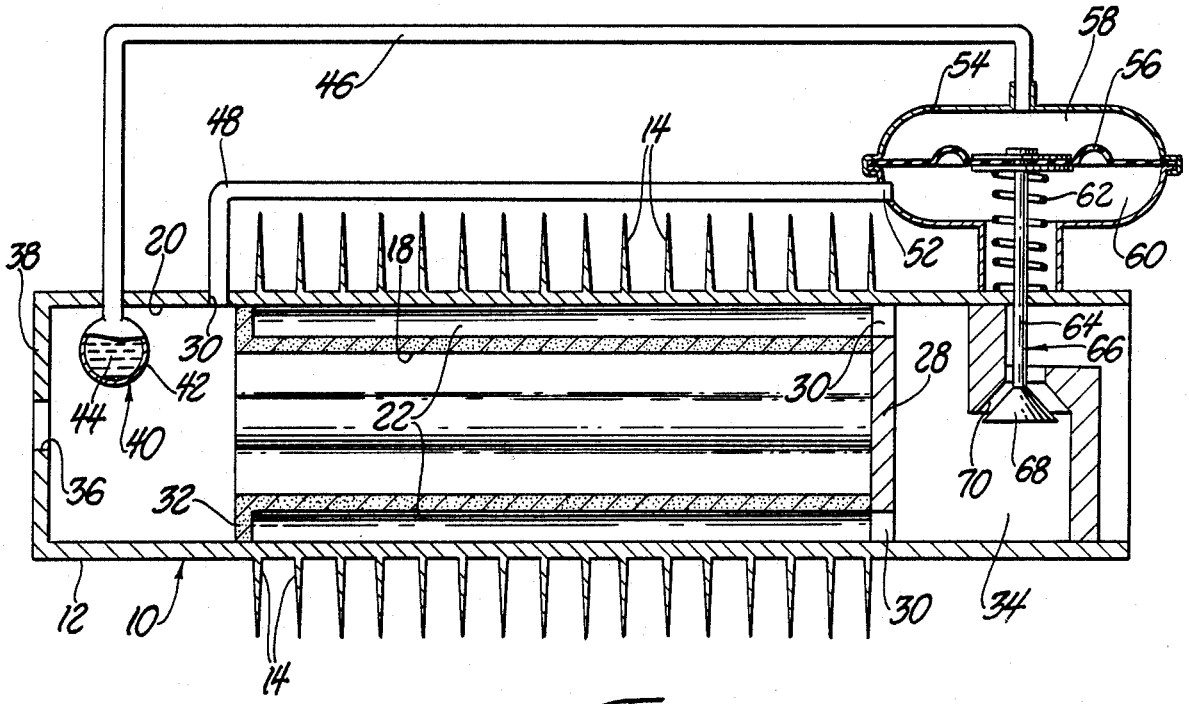
FIG. 2 is a side view, in section of a second embodiment of this invention with a control mechanism.

FIG. 2 shows an embodiment without a retention housing but having a control mechanism suitable for adjusting the flow of refrigerant liquid through the evaporator. The evaporator housing 12 has an inlet with a plate 28 having a plurality of openings 30 communicating with and corresponding in number and orientation with arteries 22 in the porous wicking layer 18. The openings 30 allow the liquid refrigerant to pass through and into the porous medium and run longitudinally along the evaporator 16. As shown, the longitudinal arteries 22 are closed at the end distal the inlet but they could be open if so desired. If the arteries 22 are closed the liquid would be unable to flow freely through the refrigerant tube and would be forced to exit through the porous structure when it hits the end of the artery.

The evaporator in FIGS. 1 and 2 would normally be connected to a compression system in a manner well known in the air conditioning or fluid treating art. Such compression systems deliver a liquid refrigerant into an inlet chamber 34 and the resulting liquid would be transformed by a phase change into a low-pressure vapor which would exit the housing through an outlet 36 formed in the end wall 38 of the evaporator. The low-pressure vapor would be recycled into the compressor for recompression and use. An entire system would comprise an evaporator, condenser, compressor, and various connecting and valving mechanisms to maintain and control refrigerant flow. The basic compressor and valving structures are well known in the art and design of cooling systems. A detailed description of the compressor, condenser, and the associated fluid connections necessary to use the evaporator of this invention is omitted in the interest of brevity.

FIG. 2 shows a controlling mechanism useful for regulating the amount of liquid refrigerant which enters the evaporator. Control of the liquid refrigerant is desirable so when the wick is covered with liquid refrigerant, the refrigerant vapors should be at the saturation temperature which corresponds to the pressure in the evaporator tube. When the wick is dry, the vapors would contact the warm wall of the evaporator and become superheated. It is desirable to regulate the superheat in the evaporator since too much superheat would penalize the efficiency of the refrigeration circuit and too little superheat risks flooding the evaporator with liquid refrigerant. If the evaporator becomes flooded, the liquid could enter the compressor causing damage.

As shown in FIG. 2 regulation of the amount of superheat can be regulated by means of a thermal expansion valve designated generally 40 which comprises a bulb 42 filled with a liquid 44. As the liquid 44 is exposed to the increasing temperature from gas flow through the evaporator to the outlet 36, the increasing temperature on the liquid will cause an increase in the vapor pressure above the liquid causing the pressure in line 46 to rise as a function of temperature. A reference pressure is provided by reference line 48 which has one end 50 opening into the evaporator 10 and a second end 52 opening into a diaphragm housing 54. The diaphragm housing 54 has a flexible diaphragm 56 disposed across the diaphragm housing dividing the diaphragm housing into two chambers a activation chamber 58 and a reference chamber 60. The pressure in the reference chamber 60 will be maintained at the same interior pressure as the evaporator housing 12. As the superheat of the refrigerant being exhausted increases, the temperature of the bulb 40 will rise. Because the activation chamber 58 is fluidly connected to the temperature bulb 42, the pressure in line 46 rises as a function of temperature causing an increase in pressure in chamber 58 which will move the diaphragm 56 downward as shown in the drawing. The downward pressure will overcome the force of a biasing means 62 shown as a coil spring wrapped about a valve stem 64. As shown, the valve designate generally as 66 has a head 68 located within the inlet chamber 34 and adapted to seat against a shaped valve seat 70 to provide a fluid-tight seal. Both the valve and the valve seat are shown as frusto conical sections although other valve head configurations and seating configurations are known in the art and other valve seating configurations are possible.

During operation as the temperature of the refrigerant in the gaseous phase exiting the evaporator raises the pressure of the bulb 42, the diaphragm moves against the biasing means and the valve opens allowing additional liquid refrigerant into the system. As the temperature of the refrigerant exiting the evaporator slowly decreases, the pressure in line 46 will correspondingly decrease and the biasing means will move the diaphragm into the housing allowing the valve to slowly close until a steady-state configuration is achieved.

Because the wicking layer 18 is porous, the surface tension inherent in liquids will allow the liquid to flow and wick along the interior of the housing wetting the interior of the housing and allowing the conversion to the vapor state which promotes cooling. As soon as the refrigerant liquid charged at the inlet 24 has turned to a vapor it is free to pass through the porous wick into the center of the housing and exhaust through the outlet 36. Because the wick can carry the refrigerant longitudinally and radially within the housing to the inner surface of 20 of the housing 12, the interior surface of the housing will be maintained in a damp condition at all times allowing the maximum cooling effect without regard to the orientation of the evaporator. If the porous wicking layer 18 were not present in the evaporator tube, the interior of the housing would not be maintained damp with refrigerant throughout its length unless the housing was filled with refrigerant. This is not practical in all devices and it is often desirable to have the refrigerant enter the evaporator as a liquid and exit solely as a gas. This is particularly true in portable applications such as might be used in the micro-atmospheric suits and micro climate structures proposed for battlefields exposed to chemical, biological and nuclear contamination.

With respect to producing evaporators of the invention, the evaporator housing, fins, porous wick and related lines and connections would generally be of a metallic nature to provide a substance which would allow easy heat flow from the refrigerant liquid to the fluid being cooled. In producing such a device the metal housing can have the fins 14 attached to its exterior surface by welding, braizing, or where the fins are longitudinally disposed as shown in FIG. 1 by extrusion. The preferred embodiment will have the exterior fins or spines lifted from the parent material of the housing 12 to provide extra heat transfer area and also increased turbulence in the fluid flowing over the exterior surface of the evaporator. Both the increased surface and the increased turbulence augment the heat transfer of the invention. Other augmentation methods which would provide increased surface area and turbulence are known in the art and could be used with the evaporator of this invention.

To form the interior wicking surface where the housing and the wick are to be made of a metal material, the housing could be placed in a fixture and a mandrel placed inside the housing having a shape of the final void volume. The housing can then be filled with a powdered metal material and heated to a temperature where the metal powder begins to sinter but prior to the point at which substantial melting occurs. The resulting assembly can then be cooled and the mandrels removed to provide the final void spaces. U.S. Pat. No. 4,196,504 discloses a method of forming a porous structure having arteries inside of a tubular structure; the disclosure of this patent with respect to methods for forming porous structures and types of structures which can be formed are incorporated herein by reference.

Figure 3:
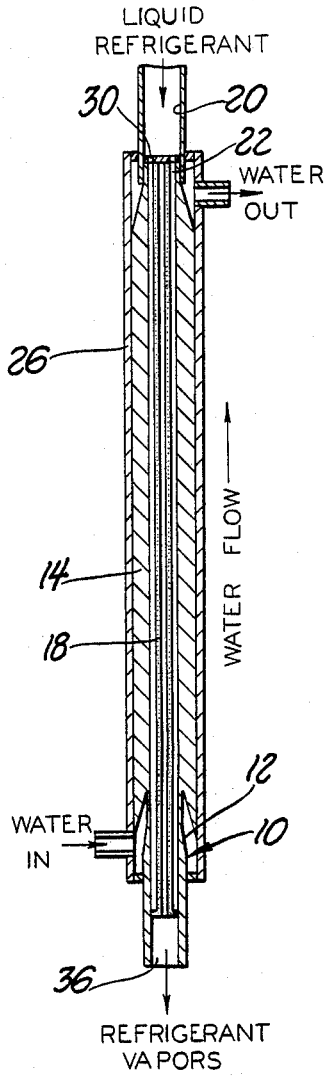
FIG. 3 shows various evaporator structures which have been experimentally tested.
Figure 4:
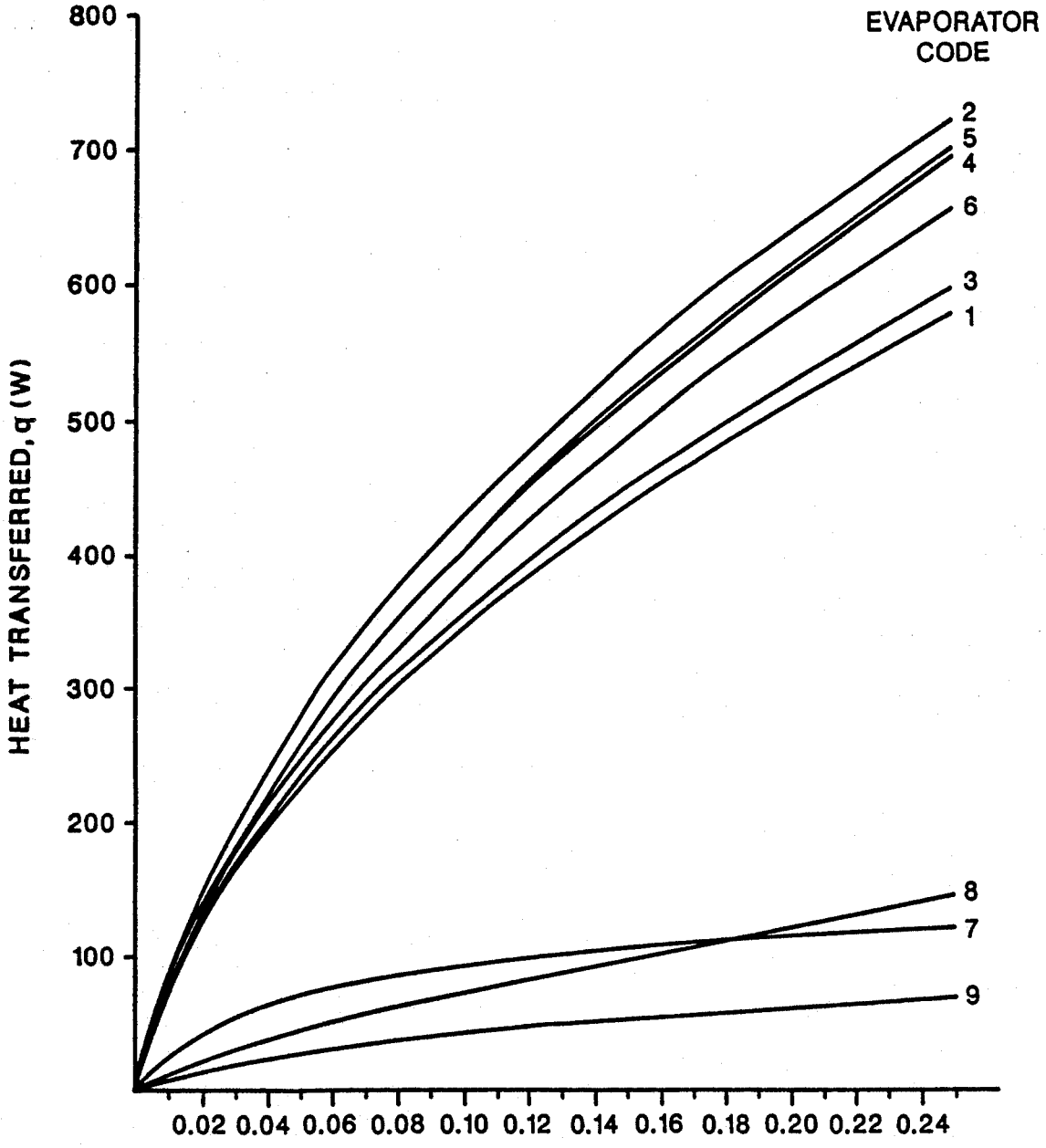
FIG. 4 shows heat transfer results for the evaporators shown in FIG. 3.

A number of evaporator geometries which have been experimentally tested are shown in FIG. 3. The evaporators were constructed as 12 inch lengths of $\frac{3}{8}$ in diameter high thermal conductivity 102 copper. The outer surface of the housing had spines which were lifted from the parent material into various configurations; the spines were formed so the diameter of the spines was about 1.5 inches. The interior space had a porous wick formed of sintered copper powder which was manufactured by Alcan or Amax. The heat transferred for an evaporator which is 12 inches long is shown in FIG. 4. The various spined and unspined evaporators were placed in a 1 inch ID acrylic jacket 26 fitted with nipples at opposite ends. The tubes 10 were smaller than the spines so the tips were bent to allow the spines to fit aside the jacket. The jacket arrangement allowed a counterflow of water between the jacket and the evaporator housing. A compressor-condenser system was attached to the evaporators and pure dichlorotetrafluroethane used as the refrigerant. Water pumped through the jacket had its inlet and outlet temperature monitored and the flow rate was measured. This data could be used to calculate the heat transfer of the evaporator. A conventional evaporator which has neither spines nor a sintered metal interior is designated "Evaporator 9" to provide a base line evaporator. "Evaporator 8" has only a sintered metal interior. It removes 1.5–2 times more heat than the conventional evaporator. "Evaporator 7" has only spines. It removes twice as much heat as the conventional evaporator. "Evaporators 1–6" have both spines and a sintered metal interior. These evaporators remove 8–10 times more heat than the conventional evaporator at a given waterflow. Thus, it is seen that there is synergism between the spines on the exterior and sintered metal interior; that is, the total effect is greater than the sum of the individual effects. This results because the inside heat transfer coefficient depends on the amount of heat transferred. The exterior spines increase the amount of heat that is transferred and hence increase the interior heat transfer coefficient. In essence, the more heat that is transferred, the more heat that can be transferred.

In summary, from the FIG. 4, it can be clearly seen that either fins geometry 7 or an internal wick geometry 8 individually provide slightly better heat transfer than a normal bare wall. In contrast even the least efficient evaporator structure with both fins and a porous wicking layer has a markedly better heat transfer rate. With respect to spine orientation, it appears that spines which are spiral oriented against the flow provide better heat transfer probably by increasing turbulence.

For certain specialized applications, it may be desirable to have the evaporator made from material with increased resistance to certain chemical environments but with a penalty of a slightly lower thermal conductivity. Such a system might have a glass tube housing with spherical glass beads held to the interior by means of a chemical binder. One example of particulate material coated with a non-tacky, powdered thermal setting resin is disclosed in U.S. Pat. No. 3,175,935. Such free flowing resin coated beads can be poured into a suitable housing around the desired mandrel to form the desired wicking material and the body then heated to cure the resin in situ within the housing. Heating will cause the contiguous beads to become bounded together and then cured in a thermal set resin matrix forming a solid, consolidated composite porous body suitable for wicking a fluid material to the surface of the evaporation tube. Such beads being spherical in nature are easily handled and can form a highly uniform porous material suitable for use as a wick. Such beads in the appropriate resin can be chosen to be chemically inert to the desired chemicals passed through the evaporator if chemical resistance is an important aspect of the evaporator. Alternatively, glass or plastic beads without a chemical binder could be sintered in a manner analagous to the metal powder. It is believed that the metallic housing and sintered metallic liner will be the most common application in battlefield conditions where the evaporator tube will be exposed to severe shock.

We wish it to be understood that we do not desire to be limited to the exact details of construction shown and described for obvious modifications will occur to a person skilled in the art, without departing from the spirit and scope of the appended claims.

We claim:

1. A high efficiency evaporator tube for use with a refrigerant liquid, the outer surface of the evaporator being exposed to a fluid to be cooled, comprising: a housing having an inlet and an outlet the outer surface of the housing having a finned surface extending outwardly away from the housing's outer surface, the finned surface being in contact with the fluid to be cooled; a porous, liquid wicking layer disposed within the housing, the liquid wicking layer being disposed on and attached to the inner surface of the housing, the porous wick having at least one longitudinally extending artery formed within and surrounded by the porous wicking layer, the artery having an open end at the housing inlet to receive and allow liquid to easily enter the artery, the artery being closed at the end opposite the inlet to hamper the flow of liquid and prevent liquid from freely exiting the artery in the liquid phase, the porous layer is adapted to wick a refrigerant liquid longitudinally from the inlet along the housing and into contact with the inner surface of the housing where it can be vaporized, the porous layer allows the vapor generated to escape from the porous layer into a longitudinal channel formed within the porous wicking layer, the longitudinal channel receiving the vapor generated when the refrigerant liquid vaporizes and allowing the vapor refrigerant to exit the outlet, the capillary action of the porous layer being capable of dispensing refrigerant throughout the housing so the refrigerant liquid is present in the housing without regard to the housing's orientation; a source of refrigerant liquid for feeding the evaporator and a valve means disposed between the housing inlet and source of refrigerant liquid to control the flow of liquid into the artery.

2. The evaporator of claim 1 where the housing is formed of a metallic material and the porous wicking layer is sintered powder metal metallurgically bonded to the inner surface of the housing.

3. The evaporator of claim 1 further including a second retention housing surrounding and enclosing the exterior of the first housing and the fluid contacting members to form an enclosed area, the second housing having an inlet and an outlet for the fluid to be cooled, the second housing serving to contain the fluid to be cooled.

4. The evaporator of claim 1 where the porous wicking layer comprises resin consolidated glass beads.

5. The evaporator of claim 1 further including: a control means adapted to sense the superheat of the refrigerant after it has been converted to the vapor phase and generate an output which adjusts the valve means to control the flow of refrigerant liquid into the evaporator.

6. The evaporator of claim 5 wherein the control and sensing means includes: a valve seat formed in the inlet to the housing; a valve moveable between an open and a closed position, the valve cooperating with the valve seat to seal the inlet, biasing means serving to bias the valve towards a closed position, a valve enclosure; a diaphragm disposed across the valve enclosure dividing the enclosure into a first compartment and a second compartment, a first open tube fluidly connecting the interior of the housing and the first chamber to maintain the first chamber at the pressure of the housings interior; and a liquid containing temperature bulb located near the outlet of the housing, the bulb being fluidly connected to the second compartment, whereby when the temperature of the outlet increases, the pressure in the second compartment will increase moving the valve to a more open position.

* * * * *